US007634923B2

(12) United States Patent
Fujita et al.

(10) Patent No.: US 7,634,923 B2
(45) Date of Patent: Dec. 22, 2009

(54) TERMINAL KNITTING TEXTURE AND CLOTHING PROVIDED WITH THIS TERMINAL KNITTING TEXTURE

(75) Inventors: Mitsunori Fujita, Osaka (JP); Yoshihide Hara, Kyoto (JP)

(73) Assignee: Gunze Limited, Kyoto (JP)

( * ) Notice: Subject to any disclaimer, the term of this patent is extended or adjusted under 35 U.S.C. 154(b) by 0 days.

(21) Appl. No.: 12/093,029

(22) PCT Filed: Nov. 1, 2006

(86) PCT No.: PCT/JP2006/321821

§ 371 (c)(1),
(2), (4) Date: May 8, 2008

(87) PCT Pub. No.: WO2007/055128

PCT Pub. Date: May 18, 2007

(65) Prior Publication Data

US 2009/0044572 A1 Feb. 19, 2009

(30) Foreign Application Priority Data

Nov. 10, 2005 (JP) ..... 2005-326753

(51) Int. Cl.
*D04B 9/24* (2006.01)

(52) U.S. Cl. ..... 66/172 E

(58) Field of Classification Search ..... 66/172 R, 66/172 E, 169, 170

See application file for complete search history.

(56) References Cited

U.S. PATENT DOCUMENTS 2,121,857 A * 6/1938 Carley ..... 66/172 E
2,139,606 A * 12/1938 Scholz ..... 66/172 E
2,251,531 A * 8/1941 Thurston et al. ..... 66/172 E
2,333,870 A * 11/1943 Lawson ..... 66/172 E
3,237,431 A * 3/1966 Lawson ..... 66/41
4,499,742 A * 2/1985 Burn ..... 66/172 E
4,548,057 A * 10/1985 Essig ..... 66/172 R
4,551,994 A * 11/1985 Vailati et al. ..... 66/193
5,429,555 A * 7/1995 Beckh ..... 474/267
5,456,096 A * 10/1995 Mitsumoto et al. ..... 66/69
5,669,244 A * 9/1997 Okuno ..... 66/64

FOREIGN PATENT DOCUMENTS

JP 2-308 1/1990
JP 2002-146609 5/2002
JP 2004-124291 4/2004

OTHER PUBLICATIONS

English language Abstract of JP 2004-124291, Apr. 22, 2004.
English language Abstract of JP 2002-146609, May 22, 2002.

* cited by examiner

*Primary Examiner*—Danny Worrell
(74) *Attorney, Agent, or Firm*—Greenblum & Bernstein, P.L.C.

(57) ABSTRACT

A terminal knitting texture for a single welt consisting of a single knit that starts knitting on a terminal side, wherein a plurality of courses in an antirun area at knit starting are knit without being knit at all the wales, and are knit by using first-kind knitting yarns consisting of single covering yarns provided with thick elastic core yarns in the antirun area so as to provide knitting not causing outward curls with the first-kind knitting yarns in the antirun area. In a welt knitting area continuous to the antirun area, a course knitted with the first-kind yarns is combined with a course knitted with knitting yarns lower in stretching/shrinking force than the first-kind yarns.

6 Claims, 9 Drawing Sheets

FIG.9

| | | 10 | | | | | | | | |
|---|---|---|---|---|---|---|---|---|---|---|
| | | 10-1 | 10-2 | 10-3 | 10-4 | 10-5 | 10-6 | 10-7 | 10-8 | ..... 10-n |
| 2 | C1 | ○ | × | × | × | ○ | × | × | × | |
| | C2 | × | × | ○ | × | × | × | ○ | × | |
| | C3 | ○ | × | × | × | ○ | × | × | × | |
| 3 | C4 | ○ | × | ○ | × | ○ | × | ○ | × | |
| | C5 | ○ | × | × | × | ○ | × | × | × | |
| | C6 | ○ | × | ○ | × | ○ | × | ○ | × | |
| | C7 | ○ | × | △ | × | ○ | × | △ | × | |
| | C8 | × | × | △ | × | × | × | △ | × | |
| | C9 | ○ | × | △ | × | ○ | × | △ | × | |
| | C10 | ○ | × | ○ | × | ○ | × | ○ | × | |
| | C11 | ○ | × | △ | × | ○ | × | △ | × | |
| | C12 | × | × | △ | × | × | × | △ | × | |
| | C13 | ○ | × | △ | × | ○ | × | △ | × | |

TERMINAL KNITTING TEXTURE AND CLOTHING PROVIDED WITH THIS TERMINAL KNITTING TEXTURE

TECHNICAL FIELD

The present invention relates to a terminal knitting texture and clothing such as top underwear and bottom underwear provided with the terminal knitting texture and is intended to prevent the terminal thereof from adversely affecting the appearance thereof and curling outward by forming the terminal as single knit so that the terminal is thin.

BACKGROUND ART

A welt portion such as the terminal of hems of socks, a waist hem and sleeve hems of an undershirt, and a waist hem and leg hems of shorts, and the like is mostly formed as a pouchy double welt by folding the welt portion. In this case, the terminal is thick and thus a difference in level is generated between the terminal and a portion of the body continuous with the terminal. The difference in level appears through an outerwear. A phenomenon so-called "difference in level adversely affects appearance" is liable to occur. Therefore it is preferable to form the welt portion as thinly as possible as a single welt. But when the welt portion is thin, there arises a problem that the welt portion is liable to curl outward and turn up.

That is, when the welt portion is formed as the double welt, the welt portion little curls but there arises a problem of the generation of the difference in level. On the other hand, when the welt portion is formed as the single welt, the difference in level is not generated, but there arises a problem that the welt portion is liable to curl.

Therefore conventionally there is a demand that the welt portion is formed as the single welt so that the terminal is thin and yet does not curl.

In compliance with the above-described demand, the welt portion proposed as disclosed in Japanese Patent Application Laid-Open No. 2002-146609 (patent document 1) is formed without folding the welt portion, namely, not as the double welt, but formed as the single welt consisting of the double knit fabric formed by weaving an elastic yarn. In the above-described double knit fabric, as shown in FIG. 8(A), loops R are formed on the knit stitch S1 and the purl stitch S2 with a yarn supplied to the needles N1 of the row A and the needles N2 of the row B. Therefore the double knit fabric has an advantage that the tensile force of the right side surface and that of the wrong side are balanced with each other and that the knit fabric does not curl to the right side thereof. Compared with the case in which the welt portion is knit like a pouch, the single welt allows knitting steps to be simple and the knit fabric to be thin. But the proposed single welt consists of the double knit fabric which is thicker than the single knit fabric and does not solve the problem that the difference in level is liable to be generated at the terminal.

When the welt portion is formed as the single welt consisting of the single knit fabric, the knitting speed is about three times faster than the double knit. Thus the single welt enhances productivity and is capable of thinning the welt portion. But as shown in FIG. 8(B), in the single knit fabric, the loops R are formed on only the knit stitch S1 with a yarn supplied to the needles N3 arranged side by side in a row. Thus as described above, the single knit fabric is liable to curl on the knit stitch side and turn up outward.

To solve the above-described problem, the present applicant proposed terminal knitting texture in which the welt portion is formed as the single welt consisting of the single knit, as disclosed in Japanese Patent Application Laid-Open No. 2004-124291 (Patent Document 2). As shown in FIG. 9, in the set up area 2 of the terminal knitting texture where knitting is started, the courses composed of the mixture of knit and miss are knit with an elastic yarn. The welt knitting area 3 continuous with the set up area 2 has a plurality of courses knit with a ground yarn. In each of a plurality of the courses of the welt knitting area 3, miss and tuck are combined with knit. The positions of the knit, the miss, and the tuck are so dispersed that the tensile force of the knit stitch and that of the purl stitch are balanced with each other to prevent the knit stitch side from curling.

Because the above-described terminal knitting texture consists of the single knit, the terminal knitting texture is capable of solving the problem of "difference in level adversely affects appearance" and in addition, the tensile force of the knit stitch and that of the purl stitch are balanced with each other in the welt knitting area 3. Therefore it is possible to prevent curling from being generated on the knit stitch side. In addition, because the courses of the set up area 2 composed of the mixture of the knit and the miss are knit with the elastic yarn, it is possible to impart an appropriate degree of a tightening force to the terminal and yet prevent the set up area 2 from curling outward.

The above-described terminal knitting texture of the patent document 2 consists of the single knit so that the terminal knitting texture is thin and yet can be prevented from curling at the welt portion thereof. But the terminal knitting texture has room for improvement in enhancing fitting feeling of a user at the terminal thereof and the feeling of touch when the user wears clothing having the terminal knitting texture by imparting a proper degree of a tightening force to the user's body.

Patent document 1: Japanese Patent Application Laid-Open No. 2002-146609

Patent document 2: Japanese Patent Application Laid-Open No. 2004-124291

SUMMARY

Problems to be Solved by the Invention

The present invention has been made in view of the above-described problems and has for an object thereof to provide a terminal knitting texture in which a welt portion consisting of single knit fabric is prevented from curling and which is capable of making a user feel that the terminal knitting texture fits to a user's body to a high extent by imparting a proper degree of a tightening force thereto and further making the user have an agreeable feel.

Means for Solving the Problems

To achieve the above-described object, the present invention provides a terminal knitting texture, started to be knit at the terminal side, which is formed as a single welt consisting of single knit, wherein a plurality of courses of a set up area where knitting is started is composed by knitting the set up area at not all wales, and the set up area is knit with a first-kind knitting yarn consisting of a single covering yarn having a thick elastic core yarn in such a way that the first-kind knitting yarn does not let the set up area curl outward; and in a welt knitting area continuous with the set up area, courses knit with the first-kind knitting yarn are combined with courses knit with a knitting yarn having a lower stretch force than that of the first-kind knitting yarn.

As described above, because in the set up area in which knitting is started, not all the wales are knit but a plurality of courses is continuously knit with one knitting yarn, it is possible to prevent the set up area from curling. The terminal knitting texture consists of the single knit. Thus even though the first-kind knitting yarn consisting of the thick elastic core yarn and having a higher stretch force is used as the knitting yarn, it is possible to prevent the set up area from being thick but keep the set up area thin and impart a proper degree of a tightening force to a user's body and yet prevent the set up area from curling.

In the welt knitting area continuous with the set up area, the courses knit with the first-kind knitting yarn are provided. Thereby it is possible to impart a proper degree of a tightening force to the user's body and easily prevent the welt knitting area from curling outward. Further in addition to the courses knit with the first-kind knitting yarn, the courses knit with the knitting yarn having a lower stretch force than that of the first-kind knitting yarn are provided alongside the courses knit with the first-kind knitting yarn. Thereby the welt knitting area has a lower tightening force than that of the set up area, is capable of applying a low degree of a sense of oppression to the user's body, and make the user comfortable to wear.

It is preferable that the number of the courses in the welt knitting area is set larger than that of the courses in the set up area.

More specifically, the set up area includes a first set up part having a plurality of courses disposed at the terminal side where knitting is started and a second set up part, having a plurality of courses, which is disposed continuously with the first set up part, wherein the first set up part has two to three courses; and each of the courses is composed of repeated one-wale knit and two-wale miss or repeated one-wale knit and three-wale miss, and knitting positions are shifted from one another in the wale direction; and the second set up part has three to six courses; and each of the courses is composed of repeated one-wale tuck and two-wale miss or repeated one-wale tuck and three-wale miss.

As described above, the first set up part disposed at the terminal where the knitting is started has two to three courses. Each of the courses is composed of repeated one-wale knit and two-wale miss or repeated one-wale knit and three-wale miss. The knitting yarn is supplied every two or three needles. Thereby the first set up part is capable of imparting an appropriate tightening force to the user's body and preventing the tensile force of a knit stitch from being too high. In addition, by shifting the knitting positions from one another in the wale direction, it is possible to prevent the tensile force from being partially generated.

As described above, the second set up part has three to six courses. Each of the courses is composed of repeated one-wale tuck and two-wale miss or repeated one-wale tuck and three-wale miss. Similarly to the first set up part, the second set up part is capable of imparting an appropriate tightening force to the user's body by supplying the knitting yarn every two or three needles.

Preferably the welt knitting area has courses each composed of repeated one-wale tuck and one-wale to three-wale miss and courses each composed of all-wale knitting, wherein subsequently to continuously arranged two to three courses each composed of all-wale knit, one course composed of repeated tuck and miss is provided;

the courses each composed of the repeated tuck and miss are knit with the first-kind knitting yarn; and the courses each composed of the all-wale knit are knit with a second-kind knitting yarn consisting of a single covering yarn provided with an elastic core yarn thinner than that of the first-kind knitting yarn or/and a knitting yarn having a lower stretch force than that of the second-kind knitting yarn.

As described above, by continuously forming two to three courses knit at all the wales with the knitting yarn having a lower stretch force, it is possible to make the tightening force of the welt knitting area lower than that of the set up area and thus decrease a sense of oppression and thereby make the user comfortable to wear. By using the second-kind knitting yarn consisting of the single covering yarn for the courses each composed of the all-wale knitting, the welt knitting area is agreeable to the feel.

In this case, even though the tensile force of the knit stitch is increased by the plain knitting texture, it is possible to effectively prevent the welt knitting area from curling outward and keep a proper degree of a tightening force of the welt knitting area, because the knitting yarn having a low stretch force is used for the courses composed of the all-wale knit.

The number of the courses of the welt knitting area is not limited to a specific number, but may be increased or decreased according to the function and design of clothing so that the length of the welt knitting area is adjusted. The number of the courses of the set up area may be increased to not less than 20 courses, not less than 50 courses or 100 to 300 courses.

As the first-kind knitting yarn, consisting of the single covering yarn having a higher stretch force, which is used for both the set up area and the welt knitting area, it is favorable to use a yarn composed of a polyurethane elastic core yarn having 70 to 200 decitex and nylon 6 or nylon 66 wound round the polyurethane elastic core yarn.

If the thickness of the polyurethane elastic core yarn is less than 70 decitex, the tightening force of the first-kind knitting yarn consisting of the single covering yarn is so low that there is a case in which the tightening force thereof is lower than the curling force of the welt portion. If the thickness of the polyurethane elastic core yarn is more than 200 decitex, the balance between the tightening force of the set up area and that of the welt knitting area is lost and the tightening force of the terminal knitting texture is so high that the user may feel uncomfortable to wear. It is especially favorable that the thickness of the polyurethane elastic core yarn is 100 to 160 decitex.

As the knitting yarn for the plain knitting texture for use in the courses, of the welt knitting area, which are knit at all the wales thereof, one or a plurality of kinds of the following knitting yarns (1) through (3) having a stretch force lower than that of the first-kind knitting yarn is used:

(1) The second-kind knitting yarn consisting of the single covering yarn composed of the polyurethane elastic core yarn having 10 to 40 decitex and the nylon 6 or the nylon 66 wound round the polyurethane elastic core yarn (2) Wooly nylon (3) A blended yarn consisting of cuprammonium rayon and the nylon 66

In consideration of the appearance and function of clothing provided with the terminal knitting texture, there are a case where only the second-kind knitting yarn of (1) is used; a case where the second-kind knitting yarn of (1) and the wooly nylon of (2) as a plating are used; and a case where instead of the second-kind knitting yarn of (1), the wooly nylon of (2) or the blended yarn (3) consisting of the cuprammonium rayon and the nylon 66 is used.

In the second-kind knitting yarn of (1) consisting of the single covering yarn, if the thickness of the polyurethane elastic core yarn is less than 10 decitex and even though the plain knitting texture which is used for the courses, of the welt knitting area, which are knit at all wales thereof is formed, the tightening force of the welt knitting area is so low that there may be a case in which the user cannot feel comfortable to wear. On the other hand, if the thickness of the polyurethane elastic core yarn is more than 40 decitex, the second-kind knitting yarn does not have a low power, but has a tightening force so high that the user feels uncomfortable to wear and in addition, the tensile force of the knit stitch is so high that outward curling may be generated. It is most favorable that the thickness of the polyurethane elastic core yarn is 15 to 25 decitex.

By using the wooly nylon of (2), it is possible to adjust the degree of the elongation of the welt knitting area and improve the appearance and touch of the clothing provided with the terminal knitting texture. Considering the balance between the stretch force of other yarns and that of the wooly nylon, it is preferable to use the wooly nylon having a thickness of 10 to 80 decitex.

By using the blended yarn of (3) consisting of the cuprammonium rayon and the nylon 66, it is possible to enhance the moisture absorbing/release property of the blended yarn owing to the blending of the cuprammonium rayon with the nylon 66. The preferable mixing ratio of the blended yarn is so selected that the moisture absorbing/release property of the cuprammonium rayon is not damaged. Thus it is preferable to use the blended yarn having 40 to 90 decitex.

It is preferable that the knit fabric is a tubular knit fabric knit by using a single cylinder. The tubular knit fabric of the single knit can be formed into underpants, socks, a body and sleeves of an undershirt, and the like without sewing the knit fabric. Thus the tubular knit fabric contributes to an increase of productivity.

The present invention provides clothing having the terminal knitting texture formed as the single welt consisting of the single knit. The terminal knitting texture is especially preferably used as an innerwear and socks. More specifically, as top clothing, an undershirt, a T-shirt, a tank top, a camisole, and the like are listed. The hems of the sleeve and body of the top clothing are formed as the single welt consisting of the terminal knitting texture. As bottom clothing, shorts, underpants, leggins, a girdle, leg wear, stockings, pantyhose, socks, and the like are listed. The waist hem, sleeve hems, and the like of the bottom clothing are formed as the single welt consisting of the terminal knitting texture.

By forming the waist hem, sleeve hems, and leg hems of the clothing as the single welt consisting of the single knit, the hem, cuff, and top thereof are thinly formed. Therefore the difference in level is little generated, which prevents the terminal of the innerwear from generating the phenomenon that the terminal thereof adversely affects the appearance. Because the set up area is knit with the first-kind knitting yarn consisting of the single covering yarn provided with the thick elastic core yarn and having a higher stretch force, it is possible to impart a proper degree of a tightening force to the user's body and prevent the set up area from curling outward and thus the terminal from turning up outward.

The welt knitting area is formed in combination of the courses knit with the first-kind knitting yarn consisting of the single covering yarn having a higher stretch force and the courses knit with the knitting yarn having a lower stretch force than that of the first-kind knitting yarn. Therefore the welt knitting area is capable of applying a proper degree of the tightening force to the user's body, making the user feel comfortable to wear, and giving a soft feel thereto, and preventing the welt knitting area from curling outward.

EFFECTS OF THE INVENTION

As described above, in the present invention, in a plurality of the courses of the set up area in which knitting is started, knitting is performed at not all the wales, but knit and miss are mixedly performed. Therefore it is possible to prevent the set up area from curling outward. Further the terminal knitting texture is knit with the first-kind knitting yarn consisting of the single covering yarn provided with the thick elastic core yarn and having a higher stretch force. Thus it is possible to impart a proper degree of the tightening force to the user's body and provide the user with a comfortable feeling in wearing and yet prevent the set up area from curling outward.

The welt knitting area continuous with the set up area is formed in combination of the courses knit with the first-kind knitting yarn having a higher stretch force and the courses knit with the knitting yarn having a lower stretch force than that of the first-kind knitting yarn. Therefore the welt knitting area is capable of applying a proper degree of the tightening force to the user's body, giving a soft feel thereto, and preventing the welt knitting area from curling outward.

BRIEF DESCRIPTION OF DRAWINGS

FIG. 9 is an explanatory figure showing a conventional knit fabric.

DESCRIPTION OF EMBODIMENTS

The embodiments of the terminal knitting texture and clothing provided with the terminal knitting texture of the invention are described below with reference to the drawings.

Figure 1:
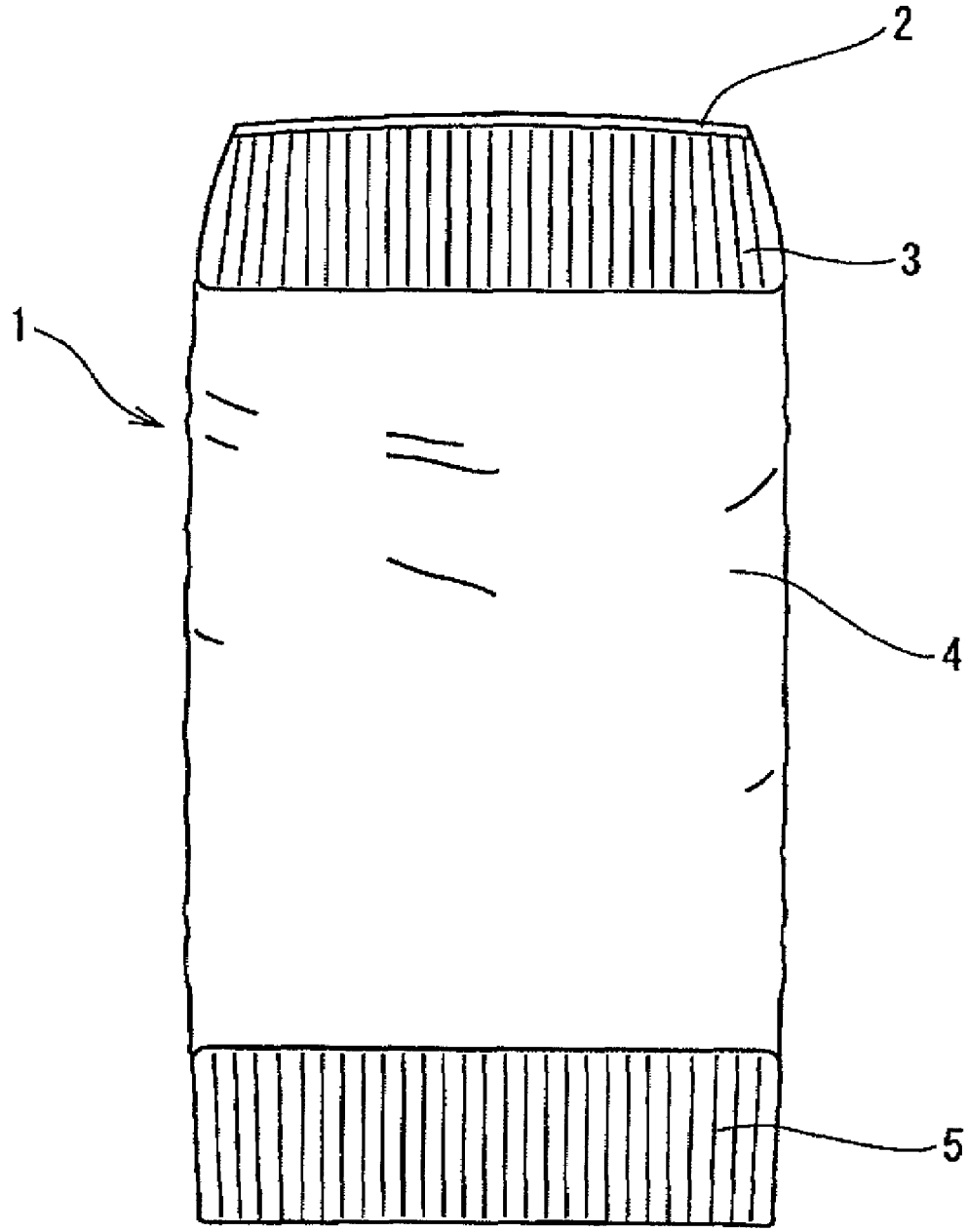
FIG. 1 is a schematic view of a tubular knit fabric having the terminal knitting texture of the invention.

FIG. 1 shows a knit fabric 1 of first embodiment knit by a single cylinder type circular knitting machine having 4 feeders with 4 inch diameter. In the drawing, the upper side is the starting side of knitting, and from the top a set up area 2, a welt knitting area 3, and a body knitting area 4 continues and at the bottom, a double welt knitting area 5 is provided.

Figure 2:
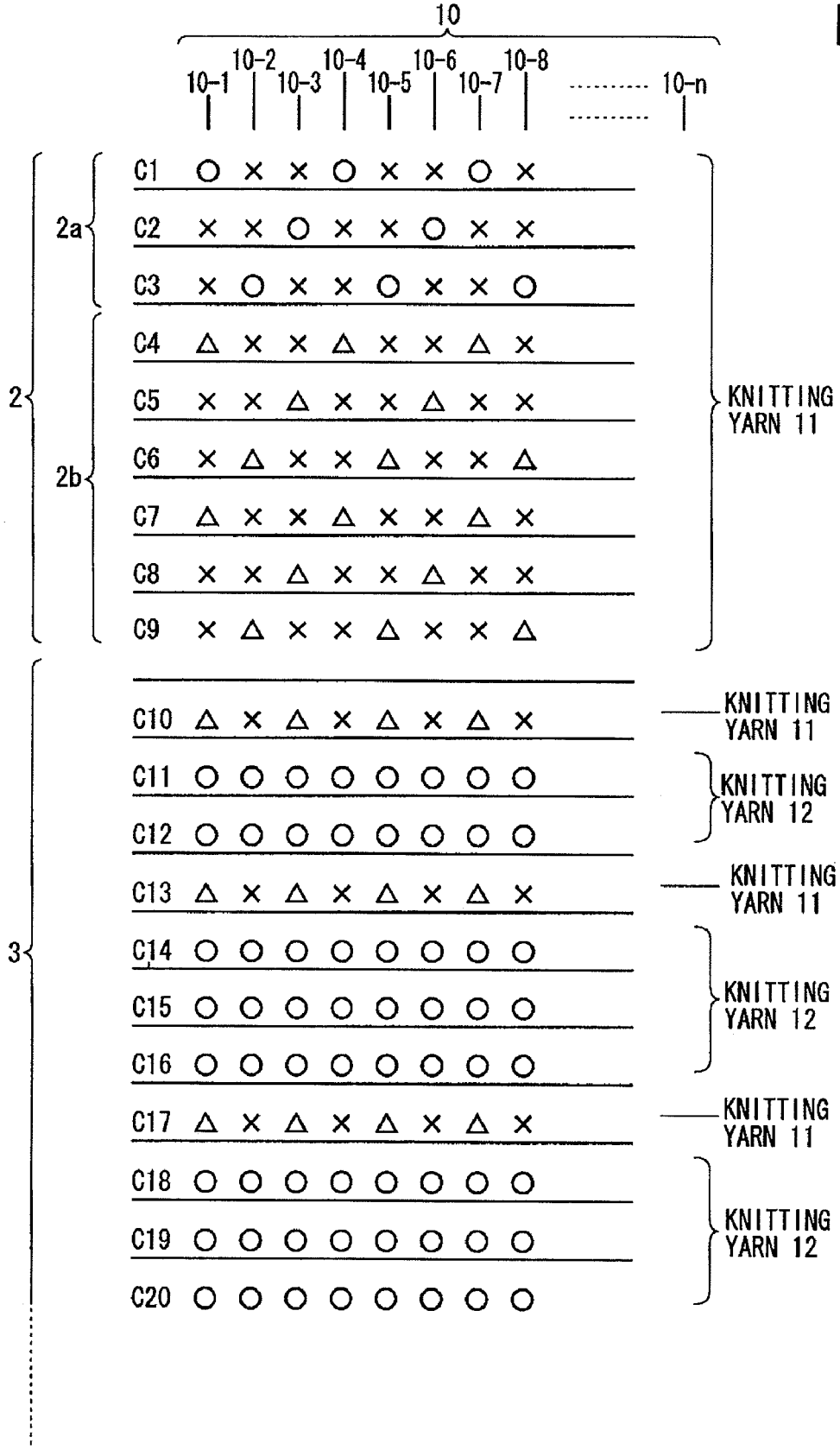
FIG. 2 is an explanatory figure showing a knit fabric of first embodiment.
Figure 3:
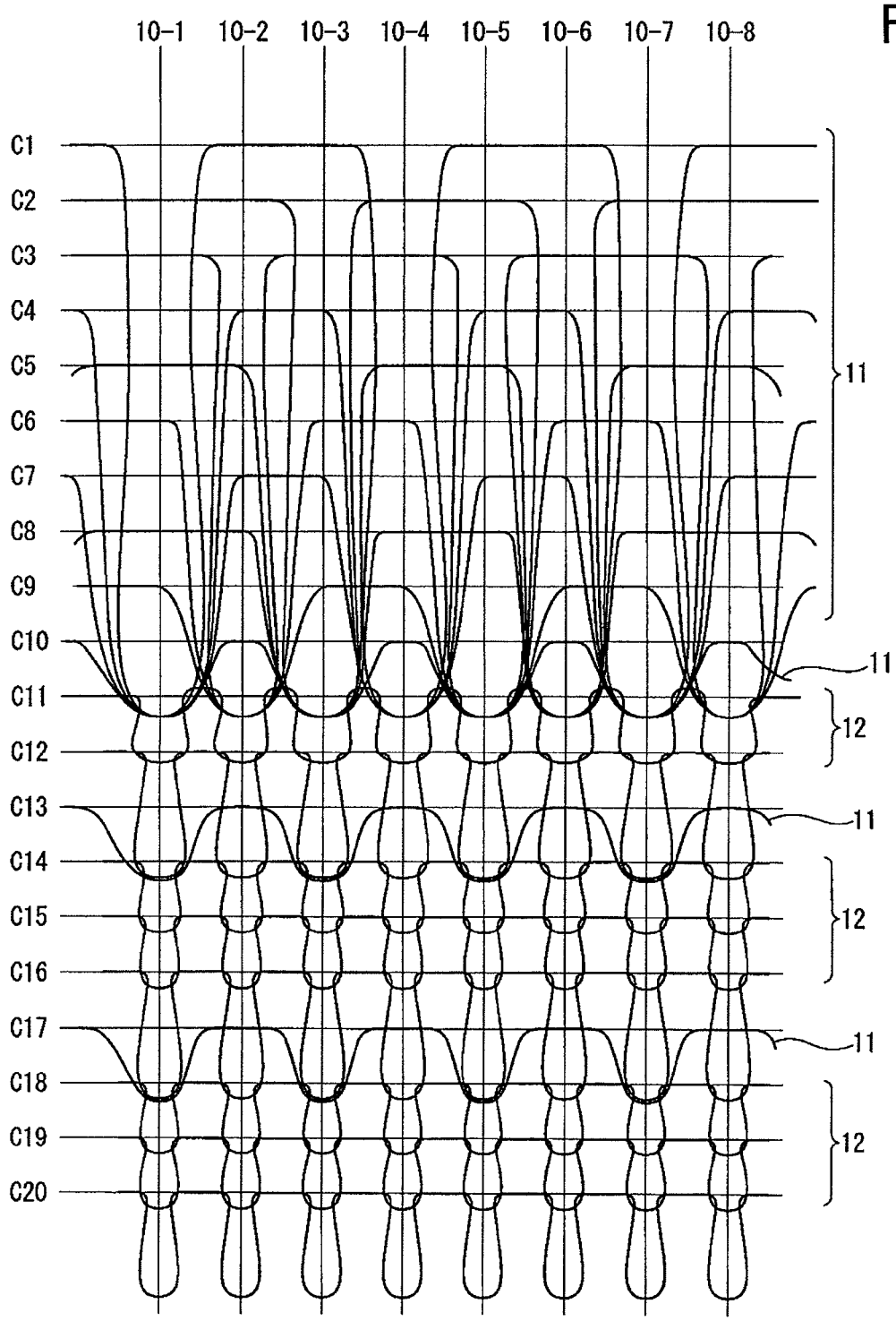
FIG. 3 shows the knit fabric of the first embodiment.

FIGS. 2 and 3 show a fabric texture of the welt knitting area 3 wherein a mark (○) under needles 10-1 in the 1st row through **10-*n* in Nth row denotes a case when the needle 10** is fed with a yarn which is called knit, a mark (x) denotes a case when the needle is skipped and not fed with a yarn which is called miss, and a mark (Δ) denotes a case when the needle having knitted in the previous course is fed with a yarn which is called tuck.

For the set up area 2 at the start of knitting, the first-kind knitting yarn consisting of the single covering yarn 11 composed of the polyurethane elastic core yarn of 130 decitex and the nylon 66 of 28 decitex wound around the polyurethane elastic core yarn. By continuously feeding the single covering yarn 11 from a feeder, three courses from 1st course C1 through 3rd course C3 which consist a first set up part 2*a*, and six courses from 4th course C4 through 9th course C9 which consist a second set up part 2*b* are knit.

In this embodiment, in the course of the first set up part 2*a*, 1-wale knit→2-wale miss→1-wale knit→2-wale miss is repeated. In the course of the second set up part 2*b*, 1-wale tuck→2-wale miss→1-wale tuck→2-wale miss is repeated.

In particular, as shown in FIGS. 2 and 3, the needle 10-1 of 1st row is positioned knit ○, the needles 10-2 and 10-3 of 2nd and 3rd rows are positioned miss x, the needle 10-4 of 4th row is positioned knit ○, the needles 10-5 and 10-6 of 5th and 6th rows are positioned miss x so that one-wale knit and two-wale miss is repeated.

In 2nd course C2 and 3rd course C3, one-wale knit and two-wale miss is repeated similarly in 1st course, but in 2nd course, the needles 10-3 and 10-6 of 3rd and 6th rows are positioned knit, and in 3rd course, the needles 10-2, 10-5 and 10-8 of 2nd, 5th and 8th rows are positioned knit. In short, the knit positions of all courses are shifted in the wale direction so that the position in one course where is the miss positions in the other courses is the knit position.

As described above, in the first set up part 2*a* of the set up area 2, one-wale knit and two-wale miss is repeated in one course, and one-wale tuck and two-wale miss is repeated in the second set up part 2*b* in knitting. Besides, the set up area 2 including the first and second set up parts 2*a* and 2*b* is knit with the elastic first-kind knitting yarn consisting of the single covering yarn 11 composed of thick polyurethane elastic core yarn so that the area is free from curling outward.

Additionally, the knit positions of all courses are shifted in the wale direction so that the position in one course where is the miss positions in the other courses is the knit position. Therefore, tension is balanced and moderate tightening force is universally and equally applied to the portion in the peripheral direction, which makes the clothing comfortable to wear.

In courses C10, C13 and C17 of the welt knitting area 3 continuing from the set up area 2, 1-wale tuck→1-wale miss→1-wale tuck→1-wale miss is repeated in knitting by feeding from one feeder, the first-kind knitting yarn with a higher stretch force which consists of the single covering yarn 11 composed of the polyurethane elastic core yarn of 130 decitex and nylon 66 of 28 decitex wound around the polyurethane elastic core yarn.

In other courses C11, C12, C14, C15, C16, C18, C19 and C20 of the welt knitting area 3, the second-kind knitting yarn with a lower stretch force consisting of the single covering yarn 12 of the polyurethane elastic core yarn of 20 decitex and nylon 66 of 28 decitex wound around the polyurethane elastic core yarn is fed from another feeder and knit at all the needles.

In particular, as shown in FIGS. 2 and 3, on 10th course C10, the needle 10-1 of 1st row is positioned tuck Δ, the needle 10-2 of 2nd row is positioned miss x, the needle 10-3 of 3rd row is positioned tuck Δ, the needle 10-4 of 4th row is positioned miss x, so that one-wale tuck and one-wale miss by the single covering yarn 11 is repeated.

Then, on 11th course and 12th course, all the needles 10-1 through 10-n are positioned knit ○ where the single covering yarn 12 having a lower stretch force is knit. After these two continuous courses, follows $13^{th}$ course C13 repeating 1-wale tuck and 1-wale miss, same as that on 10th course C10. Further, the patterns of three courses of knit only and one course repeating 1-wale tuck and 1-wale miss follows.

The length of the welt knitting area 3 may be a necessary length. Therefore, when the welt knitting area 3 is necessary to be shorter, the number of repeating course may be lessened and when the welt knitting area 3 is necessary to be longer, the number may be increased.

As described above, in the welt knitting area 3, after the continuous two courses C11 and C12 of only knit by the second-kind knitting yarn 12 having a lower stretch force, one course repeating 1-wale tuck and 1-wale miss with the first-kind knitting yarn 11 having a higher stretch force follows, then three courses of only knit by the second-kind knitting yarn 12 follow. Subsequently, by repeating the above sequence, the tightening force may become weaker than that of the set up area so that feeling of oppression decreases to improve comfortability of wearing and the fabric is effectively prevented from curling outward. Besides, the welt knitting area 3 is knit only by the first-kind and second-kind knitting yarn consisting of the single covering yarn similar to the set up area 2, which can make the feel of the area comfortable.

Figure 4:
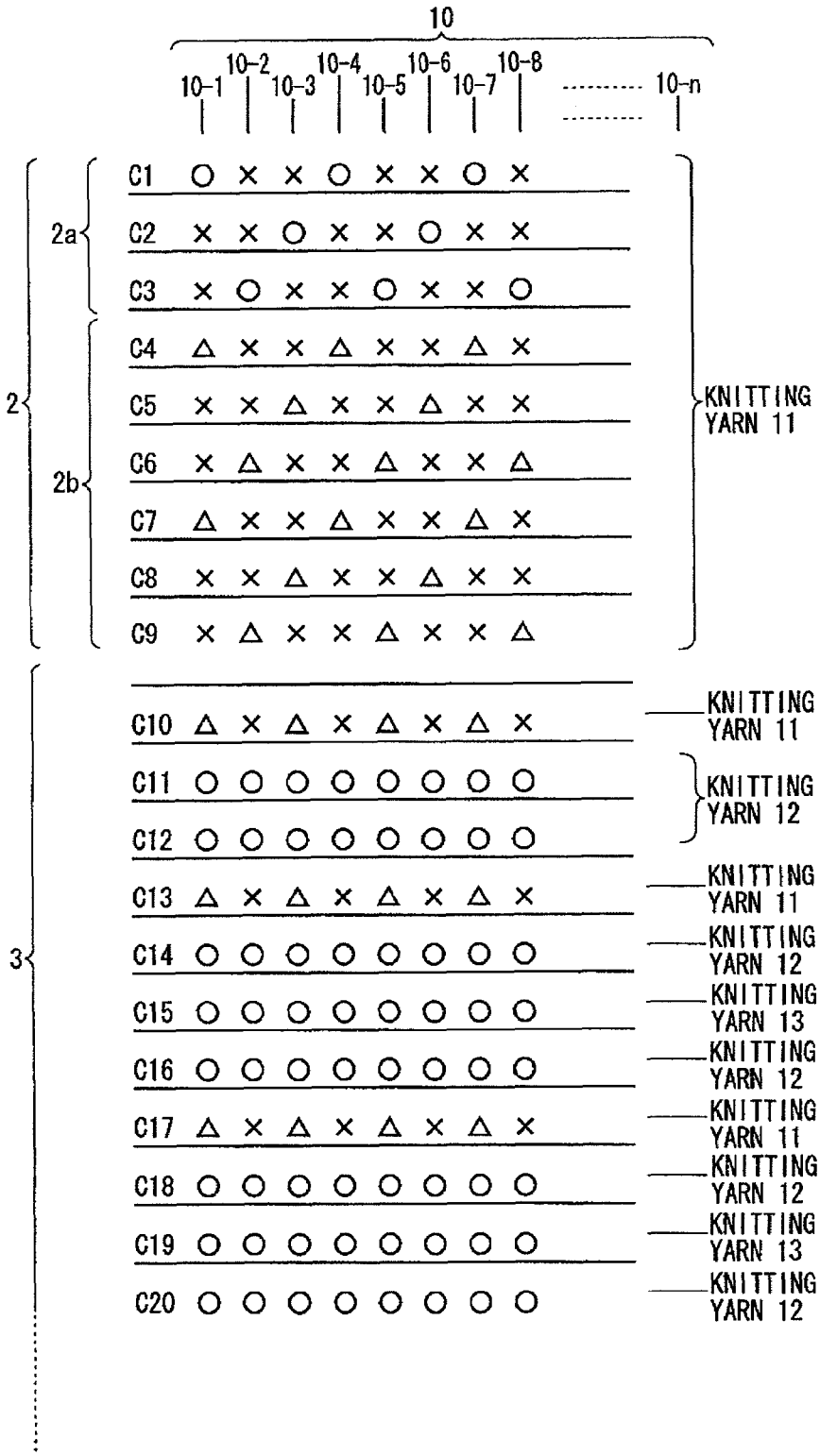
FIG. 4 is an explanatory figure showing a knit fabric of second embodiment.

FIG. 4 shows second embodiment of the invention.

The difference from the first embodiment is that in the portion of continuous three courses of knit only, the middle course is knit with a blended yarn 13 of cuprammonium rayon and nylon instead of the second-kind knitting yarn 12.

That is, on the courses C10, C13 and C17, 1-wale tuck→1-wale miss→1-wale tuck→1-wale miss is repeated by feeding from one feeder, the first-kind knitting yarn with a higher stretch force consisting of the single covering yarn 11 composed of polyurethane elastic core yarn of 130 decitex and nylon 66 of 28 decitex wound around the polyurethane elastic core yarn.

On the courses C11, C12, C14, C16, C18 and C20, the second-kind knitting yarn with a lower stretch force consisting of the single covering yarn 12 of the polyurethane elastic core yarn of 20 decitex and nylon 66 of 28 decitex wound around the polyurethane elastic core yarn is fed from another feeder and knit at all the needles.

Besides, on the courses C15 and C19, the blended yarn 13 of cuprammonium rayon and nylon 66 is fed from further another feeder and knit at all the needles in one course.

That is, in the area of the continuous three courses of knit, the cuprammonium rayon blended yarn course is laid between the second-kind yarn courses.

As described above, the two continuous courses C11 and C12 of knit only by the second-kind knitting yarn with a lower stretch force are provided, then the three courses C14 and C16 of knit only by the second-kind knitting yarn and C15 of knit only by the cuprammonium rayon blended yarn continuously follow, so that the tightening force may become weaker than that of the set up area to decrease feeling of oppression, which improves comfortability of wearing.

Besides, the course of knit only is repeated two or three times continuously, then one course of 1-wale tuck and 1-wale miss knit by the first-kind knitting yarn with a higher stretch force follows so that the moderate tightening force can be applied and the fabric can be effectively prevented from curling outward.

And yet, in the area of continuous three courses of knit only, the middle course is knit by the cuprammonium rayon blended yarn so that moisture absorption-release capability increases and feeling of wearing improves at the terminal portion which closely contacts the skin.

Additionally, since other composition is same as the first embodiment, the explanation is omitted here.

Figure 5:
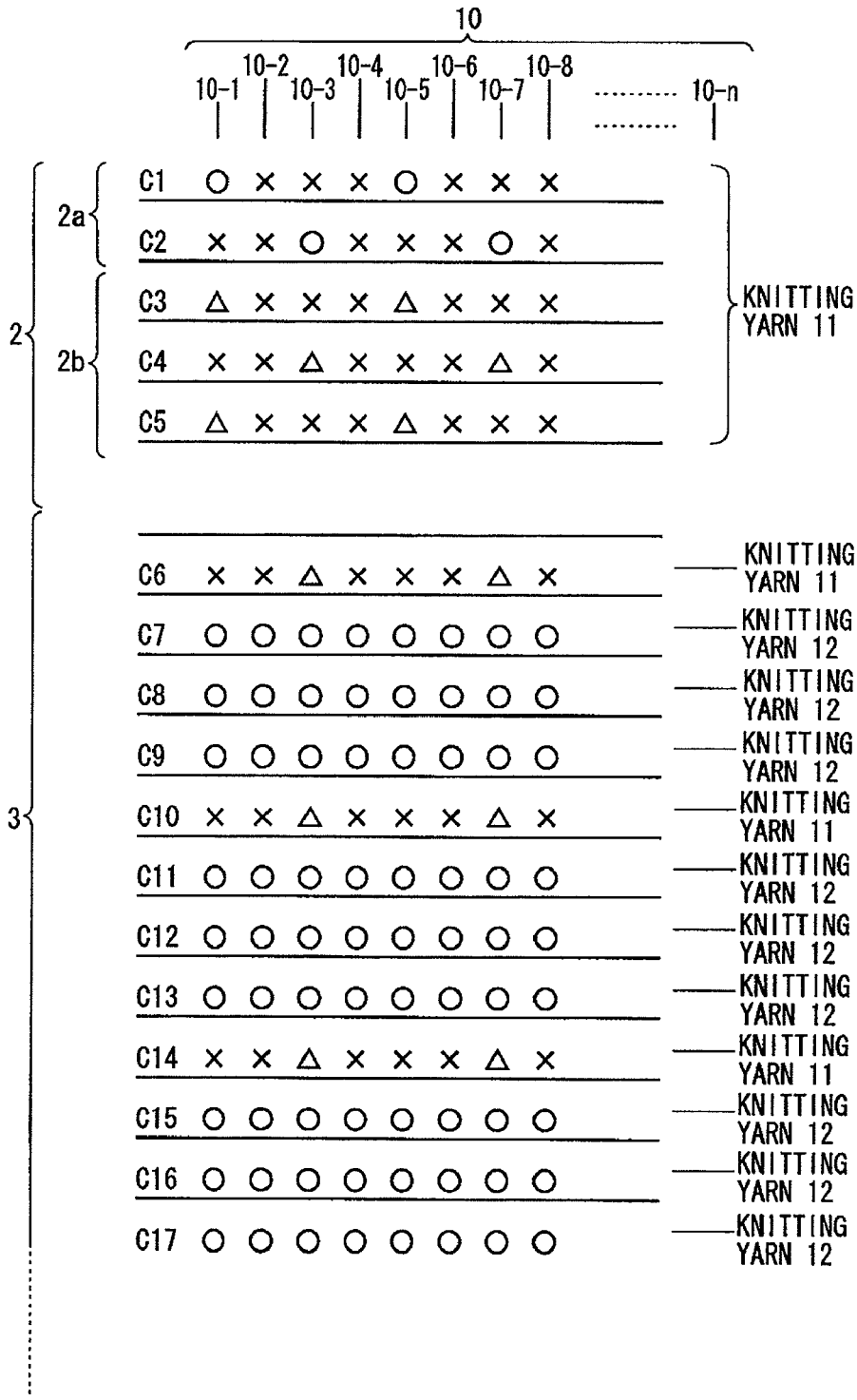
FIG. 5 is an explanatory figure showing a knit fabric of third embodiment.

FIG. 5 shows third embodiment of the invention.

In the third embodiment, the circular knitting machine having 4 feeders with 4 inch diameter is used for knitting, and the single covering yarn 11 composed of polyurethane elastic core yarn of 130 decitex and nylon 66 yarn of 28 decitex wound around the polyurethane elastic core yarn is used as the first-kind knitting yarn 11 with a higher stretch force, and the second-kind knitting yarn 12 consisting of the polyurethane elastic core yarn of 20 decitex and nylon 66 yarn of 28 decitex wound around the polyurethane elastic core yarn is used as the knitting yarn with a lower stretch force.

As shown in FIG. 5, the first set up part 2*a* consists of two courses and the second set up part 2*b* consists of three courses.

All the continuous courses of knit only in the welt knitting area 3 consist of three courses and all of the continuous three courses (C7, C8, C9) are knit with the second-kind knitting yarn.

Besides, the courses C10 and C14 between the first course C6 of the welt knitting area 3 and the three courses of knit only are knit by the first-kind knitting yarn with a higher stretch force where 1-wale tuck and 3-wale miss are repeated.

Also in the third embodiment having the above composition, the moderate tightening force is applied so that comfortability of wearing is obtained, the feel of the texture improves, and the texture is effectively prevented from curling outward.

Additionally, in the welt knitting area 3 consists of continuous three courses of knit only knit by a third-kind knitting yarn where a course knit with the blended yarn of cuprammonium rayon and nylon 66 intervenes in the middle of the three courses so that moisture absorption-release capability of cuprammonium rayon improves and it has the advantage of preventing the texture from becoming sticky at the terminal knitting texture area which closely contacts the skin.

Figure 6:
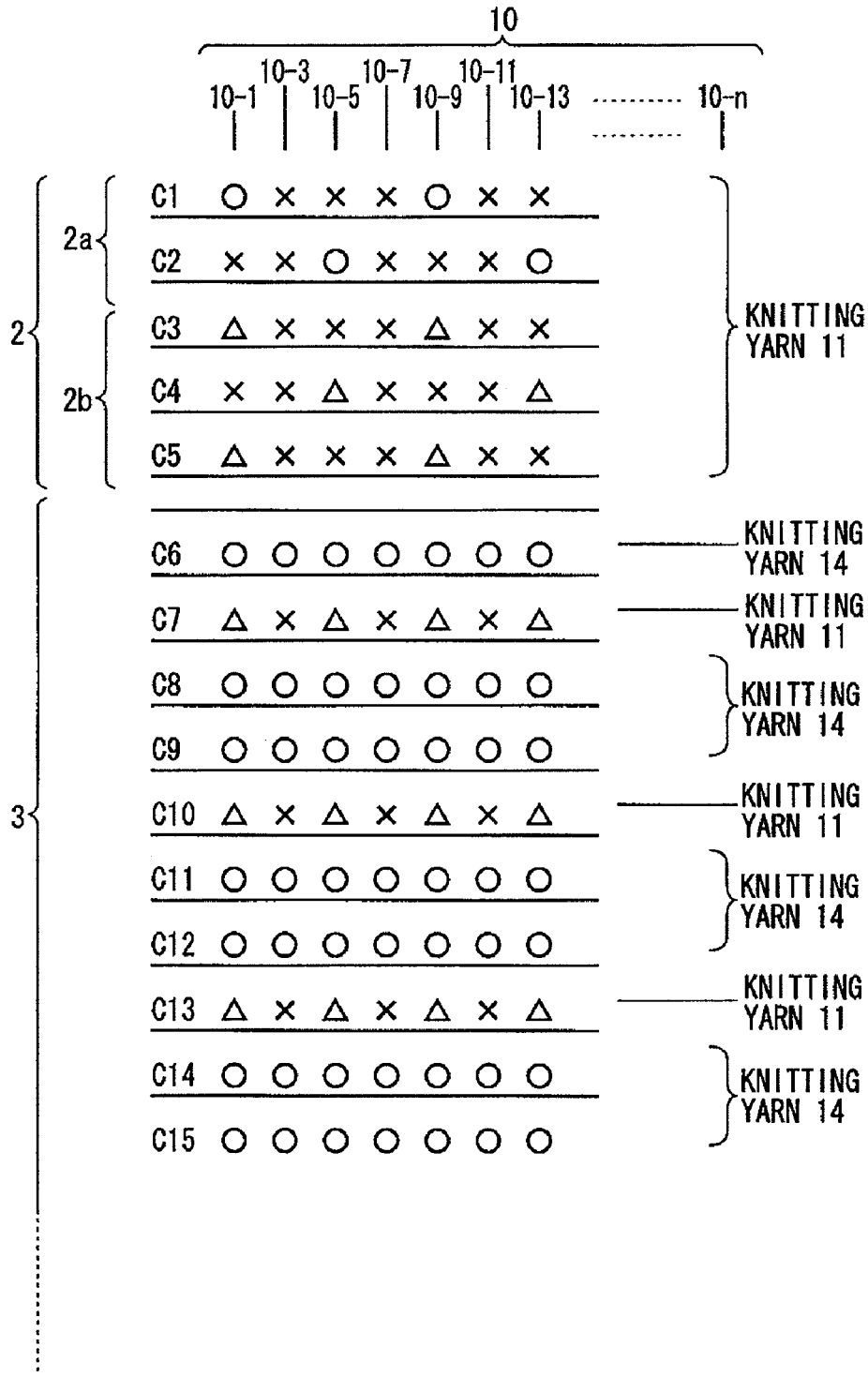
FIG. 6 is an explanatory figure showing a knit fabric of fourth embodiment.

FIG. 6 shows fourth embodiment of the invention.

In the fourth embodiment, the terminal knitting texture from the set up course to the welt knitting area is knit by a single circular knitting machine having 4 feeders with 7 inch diameter utilizing 308 needles of every two needles among 616 needles. That is, half of the whole needles such as every two needles 10-1 in 1st row, needle 10-3 in 3rd row, needle 10-5 in 5th row, needle 10-7 in 7th row, and so on are used for knitting.

Besides, the first-kind knitting yarn 11 consisting of the single covering yarn composed of the polyurethane elastic core yarn of 156 decitex and nylon 66 yarn of 78 decitex wound around the polyurethane elastic core yarn is used as the first-kind knitting yarn having a higher stretch force.

And the second-kind knitting yarn 12 consisting of the polyurethane elastic core yarn of 20 decitex and a knitting yarn 14 of wooly nylon of 66 decitex as a plating for the second-kind knitting yarn 12 are used as the knitting yarn having a lower stretch force.

To put it concretely, as shown in FIG. 6, the first set up part 2*a* of the set up area 2 consists of two courses and knit by repeating 1-wale knit and 3-wale miss. The second set up part 2*b* consists of three courses and knit by repeating 1-wale tuck and 3-wale miss.

In the welt knitting area 3, the courses C6, C8, C9, C11, C12, C14 and C15 are knit only by the above-mentioned knitting yarn 14.

As described above, after knitting the course C6 of knit only by the knitting yarn 14, knitting one course of repeating 1-wale tuck and 1-wale miss with the first-kind knitting yarn 11 having a higher stretch force, then the pattern of knitting two continuous courses of knit only and one course of repeating 1-wale tuck and 1-wale miss is repeated.

Also in the fourth embodiment, the moderate tightening force is applied so that wearing comfortability is obtained, the feel of the texture improves, and the texture is effectively prevented from curling outward.

Figure 7:
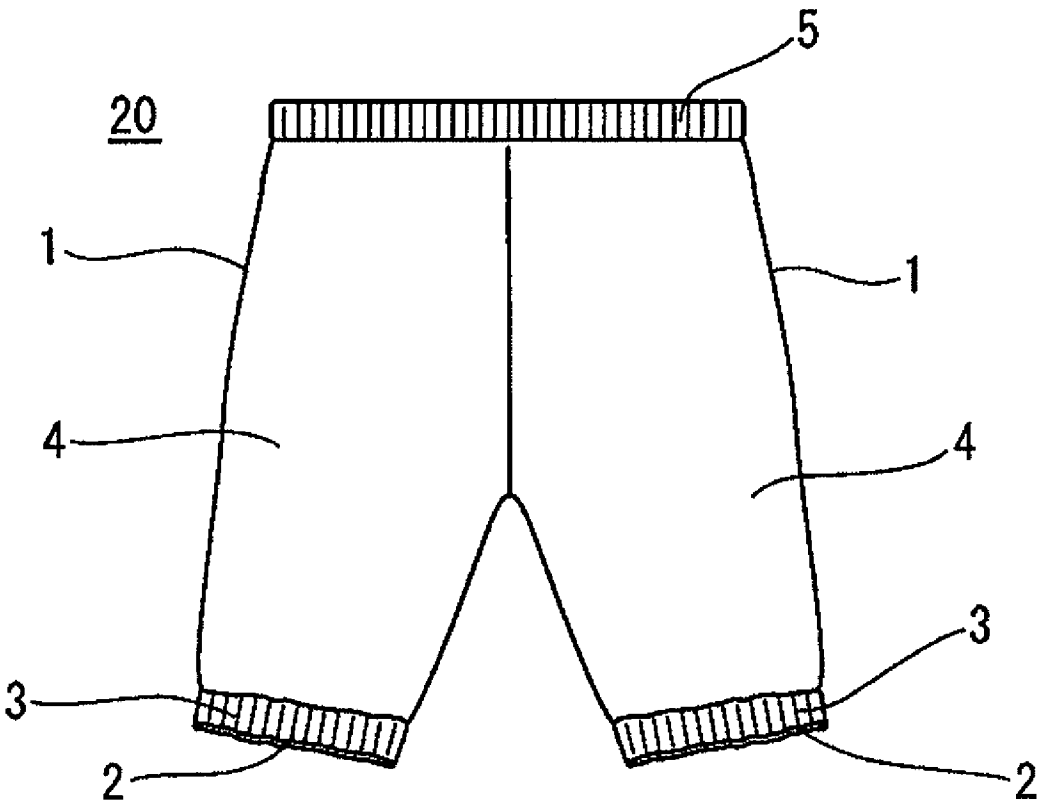
FIG. 7 is a schematic view of underpants of fifth embodiment.
Figure 8:
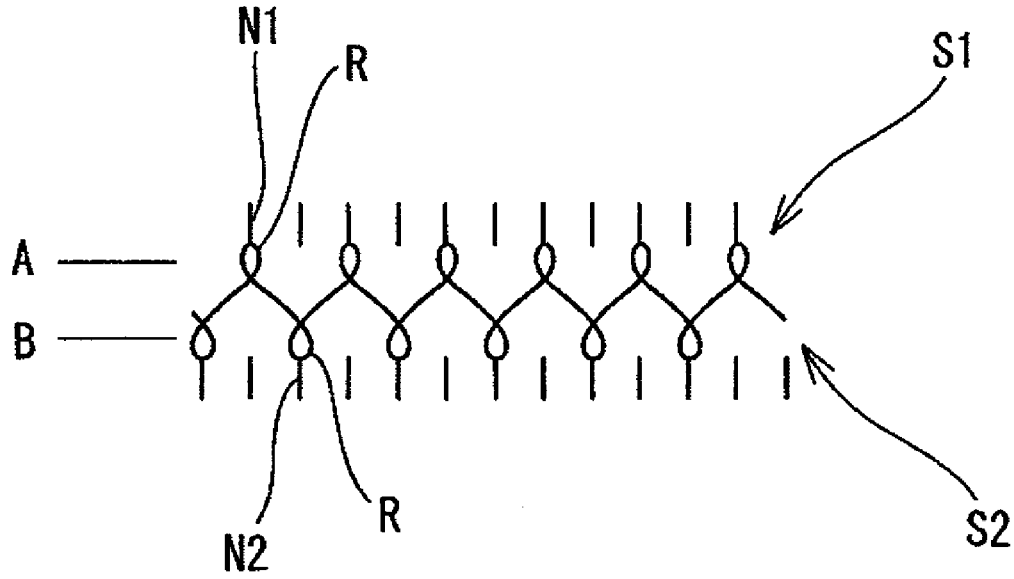
FIG. 8(A) shows a part of a conventional knit fabric.
FIG. 8(B) shows a part of another conventional knit fabric.
Figure 8:
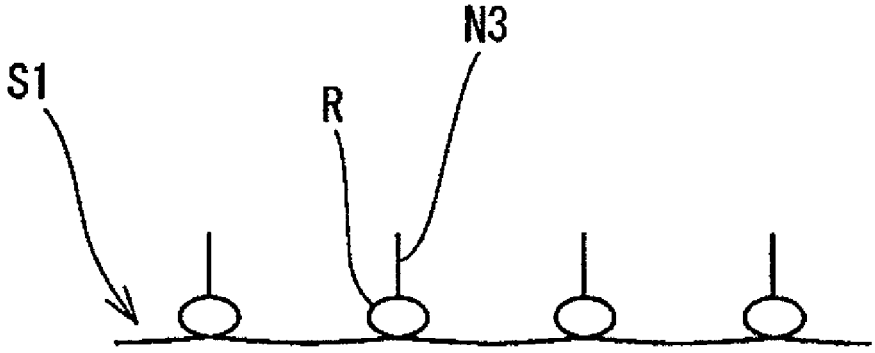

FIG. 7 shows fifth embodiment of the invention.

The fifth embodiment shows underpants 20 formed by the two tubular knit fabrics 1 of FIG. 1. The two tubular fabrics 2 are arranged side by side and the upper adjacent portions of the two tubular fabrics 2 to be a rise are cut and sew to form the underpants 20. As for this underpants 20, the both leg hems are formed single welt with the set up area 2 being placed at the bottom end, the welt knitting area continues from the set up area 2, the body knitting area 4 continues from the top of the welt knitting area to the waist hem, then the waist hem at the top end is the double welt knitting area 5.

The leg hems of the underpants 20 is single welt so that a difference in level to affect the appearance is prevented. Besides, the set up area 2 is knit by the elastic first-kind knitting yarn consisting of the single covering yarn 11 composed of the thick polyurethane elastic core yarn and not all the wales are knit so that the fabric is prevented from curling outward and moderate tightening force is applied and wearing comfortability is obtained.

In the welt knitting area 3, the courses knit by the first-kind knitting yarn with a higher stretch force consisting of the single covering yarn composed of the thick elastic core yarn and the courses knit by the second-kind knitting yarn with a stretch force lower than that of the former knitting yarn are combined. So that, the welt knitting area 3 may apply moderate tightening force to improve wearing comfortability but also apply soft feeling, and further prevent the fabric from curling outward.

If, in the above-mentioned welt knitting area 3, also combining the courses knit by the cuprammonium rayon blended yarn as the knitting yarn having a stretch force lower than that of the first-kind knitting yarn, moisture absorption-release capability is increased.

Additionally, if, in the above-mentioned welt knitting area 3, combining the courses knit by the wooly nylon yarn as the knitting yarn having a stretch force lower than that of the first-kind knitting yarn, texture characteristics improves, and the tension and appearance are balanced. In place of the wooly nylon, a knitting yarn having the similar effect, such as a cotton blended knitting yarn or the like, is applicable.

If applying the single welt of the present composition in place of the double welt knitting area 5 to the waist of the underpants 20 of the present embodiment, the similar characteristics and function may be obtained.

The invention is not limited to the above-mentioned underpants but may also be applicable to the case where sleeves of the top inner are formed by the tubular knit fabrics with hems being a single welt terminal knitting texture by the above-described single knit, or the case where the body of the undershirts is formed by the larger diameter tubular knit fabric with a hem being a single welt terminal knitting texture by the above-described single knit, the sleeve hems, body hem, and waist hem as well as the leg hems of the above-described underpants may be so thin as not to adversely affect the appearance, and besides as not to occur the outward curling. Additionally, the moderate tightening force is applied to obtain comfortability in wearing.

What is claimed is:

1. A terminal knitting texture formed as a single welt consisting of a single knit fabric comprising:

a set up area, wherein a plurality of courses of the set up area where knitting of the terminal knitting texture begins is composed of a combination of specified wale knit or wale tuck and wale miss patterns, and wherein the set up area is knit with a first-kind knitting yarn, consisting of a single covering yarn having a thick elastic core yarn, in such a way that the first-kind knitting yarn prevents the set up area of the terminal knitting texture from curling outward; and a welt knitting area which is continuous with the set up area, wherein courses knit with the first-kind knitting yarn are combined with courses knit with a knitting yarn having a lower stretch force than that of the first-kind knitting yarn, and wherein the welt knitting area has courses each composed of a repeated one-wale tuck and one-wale to three-wale miss pattern and courses each composed of an all-wale knitting pattern, wherein subsequently to continuously arranged two to three courses each composed of the all-wale knit pattern, one course composed of the repeated one-wale tuck and one-wale to three-wale miss pattern is provided, the courses each composed of the repeated one-wale tuck and one-wale to three-wale miss pattern are knit with the first-kind knitting yarn, and the courses each composed of the all-wale knit pattern are knit with a second-kind knitting yarn consisting of a single covering yarn provided with an elastic core yarn thinner than that of at least one of the first-kind knitting yarn and a knitting yarn having a lower stretch force than that of the second-kind knitting yarn.

2. The terminal knitting texture according to claim 1, wherein the set up area includes a first set up part having a plurality of first courses disposed at a terminal side of the terminal knitting texture where knitting begins, and a second set up part having a plurality of second courses which are disposed continuously with the first courses of the first set up part, wherein the plurality of first courses includes two to three courses and each of the courses is composed of a repeated one-wale knit and two-wale miss pattern or a repeated one-wale knit and three-wale miss pattern, and knitting positions of the plurality of first courses are shifted from one another in the a wale direction, and wherein the plurality of second courses includes three to six courses and each of the courses is composed of a repeated one-wale tuck and two-wale miss pattern or a repeated one-wale tuck and three-wale miss pattern.

3. The terminal knitting texture according to claim 1, wherein as the first-kind knitting yarn, consisting of the single covering yarn having the thick elastic core yarn, which is used for both the set up area and the welt knitting area, comprises a polyurethane elastic core yarn having 70 to 200 decitex and at least one of nylon 6 and nylon 66 wound around the polyurethane elastic core yarn.

4. The terminal knitting texture according to claim 1, wherein as the knitting yarn for use in the courses of the welt knitting area, which is knit at all the wales thereof, comprises at least one of the following knitting yarns having a stretch force lower than that of the first-kind knitting yarn:

(1) The second-kind knitting yarn consisting of the single covering yarn composed of the polyurethane elastic core yarn having 10 to 40 decitex and at least one of the nylon 6 and the nylon 66 wound around the polyurethane elastic core yarn;

(2) Wooly nylon; and (3) A blended yarn consisting of cuprammonium rayon and the nylon 66.

5. The terminal knitting texture according to claim 1, wherein the single knit fabric is a tubular knit fabric knit by using a single cylinder.

6. Clothing provided with the terminal knitting texture of claim 1.

* * * * *